US009978572B2

(12) United States Patent
Giles et al.

(10) Patent No.: US 9,978,572 B2
(45) Date of Patent: May 22, 2018

(54) MASS SPECTROMETER WITH REDUCED POTENTIAL DROP

(71) Applicant: MICROMASS UK LIMITED, Wilmslow (GB)

(72) Inventors: Kevin Giles, Stockport (GB); Steven Derek Pringle, Darwen (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days. days.

(21) Appl. No.: 15/307,576

(22) PCT Filed: Apr. 30, 2015

(86) PCT No.: PCT/GB2015/051262
§ 371 (c)(1),
(2) Date: Oct. 28, 2016

(87) PCT Pub. No.: WO2015/166251
PCT Pub. Date: Nov. 5, 2015

(65) Prior Publication Data

US 2017/0053785 A1 Feb. 23, 2017

(30) Foreign Application Priority Data

Apr. 30, 2014 (GB) ..... 1407611.1

(51) Int. Cl.
*H01J 49/26* (2006.01)
*H01J 49/28* (2006.01)
*H01J 49/40* (2006.01)
*H01J 49/06* (2006.01)
*H01J 49/00* (2006.01)

(52) U.S. Cl.
CPC ..... *H01J 49/0031* (2013.01); *H01J 49/063* (2013.01); *H01J 49/065* (2013.01); *H01J 49/401* (2013.01); *H01J 49/004* (2013.01)

(58) Field of Classification Search
USPC ..... 250/281–283, 287–300, 526
See application file for complete search history.

(56) References Cited

U.S. PATENT DOCUMENTS 6,791,078 B2 * 9/2004 Giles ..... G01N 27/622 250/281
6,914,241 B2 7/2005 Giles et al.
6,960,760 B2 11/2005 Bateman et al.
(Continued)

FOREIGN PATENT DOCUMENTS

GB 2392304 2/2004
GB 2409764 7/2005
WO 2004/109741 12/2004

*Primary Examiner* — Bernard Souw
(74) *Attorney, Agent, or Firm* — Womble Bond Dickinson (US) LLP; Deborah M. Vernon; Heath T. Misley

(57) ABSTRACT

A method of mass spectrometry is disclosed comprising providing a first device and a second device disposed downstream of the first device. The method further comprises introducing a potential difference between the exit of the first device and the entrance of the second device and reducing the total potential drop across the first and second devices by applying a reverse axial electric field to the first device and/or the second device. Ions are driven through the first device and/or the second device against the reverse axial electric field.

13 Claims, 2 Drawing Sheets

(56) References Cited

U.S. PATENT DOCUMENTS

| | | | | |
|---|---|---|---|---|
| 7,385,187 | B2 * | 6/2008 | Verentchikov | H01J 49/406 250/281 |
| 7,755,036 | B2 * | 7/2010 | Satoh | H01J 49/408 250/281 |
| 7,759,637 | B2 * | 7/2010 | Thomson | H01J 49/0072 250/282 |
| 8,153,441 | B2 * | 4/2012 | Liu | G01N 30/8606 436/173 |
| 8,841,608 | B2 | 9/2014 | Shvartsburg et al. | |
| 9,111,740 | B2 * | 8/2015 | Brown | H01J 49/0072 |
| 9,281,172 | B2 | 3/2016 | Bateman et al. | |
| 9,536,721 | B2 | 1/2017 | Berdnikov et al. | |
| 2002/0100870 | A1 * | 8/2002 | Whitehouse | B82Y 30/00 250/281 |
| 2011/0220786 | A1 * | 9/2011 | Satoh | H01J 49/004 250/287 |

* cited by examiner

MASS SPECTROMETER WITH REDUCED POTENTIAL DROP

CROSS-REFERENCE TO RELATED APPLICATIONS

This application represents the U.S. National Phase of International Application No. PCT/GB2015/051262 entitled "Mass Spectrometer With Reduced Potential Drop" filed 30 Apr. 2015, which claims priority from and the benefit of United Kingdom patent application No. 1407611.1 filed on 30 Apr. 2014 and European patent application No. 14166709.7 filed on 30 Apr. 2014. The entire contents of these applications are incorporated herein by reference.

FIELD OF THE PRESENT INVENTION

The present invention relates generally to mass spectrometry and in particular to mass spectrometers and methods of mass spectrometry.

BACKGROUND

A mass spectrometer typically includes a number of components arranged in-line between an ion source and an ion detector. To ensure a wide range of ions can be efficiently transmitted through the instrument, suitable voltages may be applied to focus ions along the axis and/or towards the exit of these components.

For certain applications it is necessary to introduce relatively large potential drops across or between different regions of the instrument. For instance, ions may be accelerated into a gas-filled collision cell to perform collision induced dissociation ("CID") by introducing a potential drop at the entrance to the collision cell. This potential drop determines the collision or fragmentation energy.

When operated in such a fragmentation mode, in order to transmit a continuous beam of ions through the instrument, it is necessary for all of the components upstream of the collision cell to float or track the potential drop i.e. collision energy. The total potential drop along the length of the instrument must therefore increase by an amount corresponding to the collision energy.

The same is true when transmitting a continuous beam of ions through any device requiring a large potential drop. For instance, in a drift tube ion mobility separation device ions are caused to separate according to their ion mobility along a DC potential gradient. The components upstream and downstream of the drift tube must track the DC potential gradient. Large potential drops may also be required in the ion source or transfer regions to transmit ions of high mass to charge ratio or to aid desolvation.

In some instrument geometries there may be many upstream devices, which may themselves each require an associated potential drop. Since each component must be raised to at least the same potential as the component disposed adjacently downstream of it, there is a cumulative voltage increase in the upstream direction. The cumulative effect of the various focusing voltages and potential drops results in upstream components being held at relatively high absolute potentials. This can lead to potential electrical breakdown issues.

Large potential drops across an instrument can also lead to other problems such as power supply range, safety, voltage accuracy issues and instrument control complexity.

It is known to enhance the separation characteristics of an ion mobility device using combinations of travelling waves and a reverse axial DC gradient as disclosed, for example, in GB-2409764 (Micromass), GB-2392304 (Micromass) and US 2013/0299690 (Shvartsburg).

Other electrostatic manipulations of ions within an ion guide are described in EP-1271611 (Micromass), GB-2382920 (Micromass) and WO2012/150351 (Berdnikov).

It is desired to alleviate such problems associated with introducing a large potential difference within a continuous beam mass spectrometer.

SUMMARY

According to an aspect there is provided a method of mass spectrometry comprising:

providing a first device and a second device disposed downstream of the first device;

introducing a potential difference between the exit of the first device and the entrance of the second device;

reducing the total potential drop across the first and second devices by applying a reverse axial electric field to the first device and/or the second device; and driving ions through the first device and/or the second device against the reverse axial electric field.

The techniques described herein advantageously allow for a reduction of the total potential drop along the length of a mass spectrometer incorporating a potential difference across or between its components. This is achieved by compensating for the potential difference by applying a reverse axial electric field to an upstream or downstream component of the instrument. By compensating or reducing the potential drop, the requirement for any other upstream or downstream components to track the potential drop may be reduced. This may, for instance, enable the absolute potentials of components upstream of the potential difference to be reduced. Furthermore, because the potential drop may be relatively localised, any components or devices upstream and/or downstream of the potential difference may remain static even as the potential difference is adjusted or introduced. This may allow larger potential differences to be introduced without experiencing electrical breakdown.

The potential drop between the entrance of the first device and the exit of the second device may be less than the potential difference between the exit of the first device and the entrance of the second device.

It will be appreciated that for the reverse axial field to compensate for the potential difference, the potential difference must be in the opposite sense to the reverse field gradient i.e. must be a forward potential difference or provide a forward axial field.

The method may comprise adjusting the reverse axial field to adjust the potential difference. That is, the reverse axial field applied to the first and/or second device may determine, at least in part, the potential difference between the first and second devices.

It is known to apply various combinations of electric fields to a device in order to confine and/or manipulate ions within that device for various reasons. For instance, it is known to enhance the separation characteristics of an ion mobility device using combinations of travelling waves and a reverse axial DC gradient as disclosed, for example, in GB-2409764 (Micromass), GB-2392304 (Micromass), US 2013/0299690 (Shvartsburg). Other electrostatic manipulations of ions within an ion guide are described in EP-1271611 (Micromass), GB-2382920 (Micromass) and WO 2012/150351 (Berdnikov).

It will be appreciated however that the techniques described herein relate to a method of reducing potential drops resulting from electric potentials or fields applied to one device (e.g. ion mobility spectrometry drift fields or accelerating fields) by applying a compensating field to another upstream or downstream component of a mass spectrometer. This is not disclosed in any of the above-mentioned documents.

The first and second devices may be arranged in-line between one or more upstream components such as an ion source and one or more downstream components such as an ion detector. That is, ions may pass sequentially from an upstream ion source through the first and second devices to a downstream ion detector. The first and second devices may be adjacent to each other, but need not necessarily be so.

The techniques may be performed on a continuous beam mass spectrometer.

A reverse axial electric field is one that opposes the onward transmission of ions i.e. the potential gradient increases in a downstream direction to provide a restoring force tending to return ions towards the entrance of the device.

Correspondingly, a forward axial field is one that tends to accelerate ions towards the exit of the device. It is noted that the reverse axial field and the means for driving ions against the reverse axial field need not be applied across the whole of the first and/or second device and may extend over one or more sub-sections of the first and/or second device.

The method may comprise accelerating ions through the potential difference into a fragmentation or reaction device.

The potential difference may determine a collision energy of ions entering the fragmentation or reaction device.

The second device may comprise a fragmentation or reaction device.

The fragmentation or reactive device may comprise a gas filled collision cell. The potential difference may thus be arranged to induce collision induced dissociation of ions.

The method may comprise controlling the collision energy of ions entering the fragmentation or reaction device by adjusting the reverse axial electric field.

It will be appreciated that the techniques described herein allow for a change or the introduction of a collision energy (e.g. the instrument may be switched between fragmentation and non-fragmentation modes of operation) without requiring any devices or components upstream and/or downstream of the potential difference to track the collision energy. That is, the other devices may be held static at the same potential during both the fragmentation and non-fragmentation mode.

The method may comprise providing a continuous beam of ions to the first device and the second device. It is also contemplated however that ions may be provided in a pulsed manner, and passed sequentially through the instrument (i.e. through the first and second devices) as one or more discrete packets of ions.

Driving ions through the first device and/or the second device against the reverse axial electric field may comprise:

(i) applying one or more transient DC voltages or potentials or one or more DC voltage or potential waveforms to a plurality of axial segments constituting the first and/or second device; and/or (ii) applying one or more AC or RF voltages or potentials or one or more AC or RF voltage or potential waveforms to a plurality of axial segments constituting the first and/or second device.

Alternatively/additionally, the method may comprise driving ions through the first device and/or the second device using a gas flow.

The first or second device may typically be segmented in the axial direction so that independent transient DC voltages or potentials can be applied to each segment. The transient DC voltages or potentials may generate a travelling wave which moves in the axial direction and propels ions along the device against the reverse axial electric field. The transient DC voltages or potentials may be superimposed on top of a radially confining AC or RF voltage in addition to the reverse axial electric field. The axially segmented device may comprise a multipole rod set or a stacked ring set.

The use of one or more transient DC voltages or potentials or one or more DC voltage of potential waveforms to propel ions against a reverse axial electric field is described for example in U.S. Pat. No. 6,791,078 (Micromass), U.S. Pat. No. 6,914,241 (Micromass) and US 2009/0014641 (Micromass). In these documents, however, the reverse axial electric field is not used to compensate for or reduce a potential drop along the instrument.

The reverse axial electric field may comprise a linear or non-linear electric field or may be pulsed in time.

The method may further comprise driving ions through the first device and/or the second device against the reverse axial electric field without ion mobility separation.

According to another there is provided a mass spectrometer comprising:

a first device;

a second device disposed downstream of the first device wherein, in use, a potential difference is introduced between the exit of the first device and the entrance of the second device;

a control system arranged and adapted:

(i) to apply a reverse axial electric field to the first device and/or the second device so that the total potential drop across the first and second devices is reduced; and a device to drive ions through the first device and/or the second device against the reverse axial electric field.

A mass spectrometer according to this aspect may contain or may be arranged and adapted to perform any of the features described above in relation to the first aspect.

The second device may comprise a reaction or fragmentation device.

The control system may further be arranged and adapted to control a collision energy within the reaction or fragmentation device by adjusting the reverse axial electric field.

The mass spectrometer may be operable in a fragmentation and non-fragmentation mode. The control system may be arranged and adapted to switch between the fragmentation and non-fragmentation modes by adjusting the potential difference and/or the reverse axial field applied to the first and/or second device. Any other components or devices upstream and/or downstream of the potential difference may be held at the same potential (i.e. static) in both the fragmentation and non-fragmentation mode.

The device to drive ions against the reverse axial electric field through the first device and/or the second device may be arranged and adapted:

(i) to apply one or more transient DC voltages or potentials or one or more DC voltage or potential waveforms to a plurality of axial segments constituting the first and/or second device; and/or (ii) to apply one or more AC or RF voltages or potentials or one or more AC or RF voltage or potential waveforms to a plurality of axial segments constituting the first and/or second device.

The device to drive ions against the reverse axial electric field through the first device and/or the second device may comprise a gas flow.

According to another aspect there is provided a method of mass spectrometry comprising:

providing a first device and a second device disposed upstream and/or downstream of the first device;

applying a forward axial field across the first device;

reducing the total potential drop across the first device and the second device by applying a reverse axial electric field to the second device; and driving ions through the second device against the reverse axial electric field.

The total potential drop between the first and second devices, i.e. the potential difference between the entrance of the first device and the exit of the second device, may be reduced or controlled in the same manner described above.

A method according to this aspect may involve any of the features or steps described above in relation to the first aspect to the extent that they are not mutually incompatible. For instance, as described above, the first and second devices may be arranged in-line between one or more upstream devices such as an ion source and one or more downstream devices such as an ion detector. The first and second devices may be, but are not necessarily, adjacent to each other.

The method may further comprise separating ions according to their ion mobility using the forward axial field.

The method may comprise accelerating ions through the first device using the forward axial field. The ions may be accelerated so that they collide with a buffer gas within the first device and are caused to undergo collisional induced dissociation.

Ions may optionally be driven against the reverse axial electric field without ion mobility separation.

Driving ions through the second device against the reverse axial electric field may comprise:

(i) applying one or more transient DC voltages or potentials or one or more DC voltage or potential waveforms to a plurality of axial segments constituting the second device; and/or (ii) applying one or more AC or RF voltages or potentials or one or more AC or RF voltage or potential waveforms to a plurality of axial segments constituting the second device.

The method may alternatively/additionally comprise driving ions through the second device against the reverse axial electric field using a gas flow.

The method may comprise providing a continuous beam of ions to the first device and the second device. Ions may also be provided as discrete packets. An extended or pseudo-continuous beam of ions may be generated by the first device or the device e.g. where the first or second device separates a packet of ions according to ion mobility.

According to an aspect there is provided a mass spectrometer comprising:

a first device;

a second device disposed upstream and/or downstream of the first device;

a control system arranged and adapted:

(i) to apply a forward axial field to the first device;

(ii) to apply a reverse axial electric field to the second device so that the total potential drop across the first and second devices is reduced; and a device to drive ions through the second device against the reverse axial electric field.

According to an aspect there is provided a method of mass spectrometry comprising:

reducing the potential drop between the entrance of a first device and the exit of a second downstream device by applying a reverse axial electric field to the first device and/or the second device.

The method may generally comprise introducing a potential difference or drop across the first and/or second device and/or between the first and second devices.

The method may further comprise introducing a potential difference between the exit of the first device and the entrance of the second device.

Optionally, the method may comprise controlling the potential difference by adjusting the reverse axial electric field applied to the first device and/or the second device.

Alternatively/additionally, the reverse axial electric field may be applied to the second device, the method further comprising introducing a potential difference across the first device.

Alternatively, the reverse axial electric field is applied to the first device, the method further comprising introducing a potential difference across the second device.

Driving ions through the first device and/or the second device against the reverse axial electric field may comprise:

(i) applying one or more transient DC voltages or potentials or one or more DC voltage or potential waveforms to a plurality of axial segments constituting the second device; and/or (ii) applying one or more AC or RF voltages or potentials or one or more AC or RF voltage or potential waveforms to a plurality of axial segments constituting the second device.

The method may comprise driving ions through the first device and/or the second device using a gas flow.

According to an aspect there is provided a mass spectrometer comprising:

a device arranged and adapted to reduce the potential drop between the entrance of a first device and the exit of a second downstream device by applying a reverse axial electric field to the first device and/or the second device; and a device arranged and adapted to drive ions through the first device and/or the second device against the reverse axial electric field.

According to an aspect there is provided a method of mass spectrometry comprising:

providing a first device and a second device disposed downstream of the first device;

applying a reverse axial electric field to the first device and/or the second device to introduce or adjust a potential difference between the exit of the first device and the entrance of the second device; and driving ions through the first device and/or the second device against the reverse axial electric field.

According to an aspect there is provided a mass spectrometer comprising:

a first device;

a second device disposed downstream of the first device;

a control system arranged and adapted:

(i) to introduce or adjust a potential difference between the exit of the first device and the entrance of the second device by applying a reverse axial electric field to the first device and/or the second device; and a device to drive ions against the reverse axial electric field.

According to an aspect there is provided a method of mass spectrometry comprising:

providing a first device and a second device;

applying a forward axial field across the first device;

applying a reverse axial electric field to the second device to reduce the total potential drop across the first device and the second device; and driving ions through the second device against the reverse axial electric field.

According to an aspect there is provided a mass spectrometer comprising:

a first device;

a second device;

a control system arranged and adapted:

(i) to apply a forward axial field to the first device; and (ii) to apply a reverse axial electric field to the second device; and a device to drive ions through the second device against the reverse axial electric field.

According to an aspect there is provided an apparatus for mass spectrometry comprising:

a gas cell with a reverse axial field and a travelling wave climbing the axial potential hill imposed by the reverse axial field; and a potential difference between the exit of an upstream device and the entrance to the gas cell wherein the potential difference is introduced, at least in part, by changing the potential gradient of the axial field within the gas cell.

The potential difference may be introduced to control the level of fragmentation of ions in the gas cell.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments together with other arrangements given for illustrative purposes only will now be described, by way of example only, and with reference to the accompanying drawings in which.

DETAILED DESCRIPTION

Various conventional modes of operation will first be described.

Figure 1:
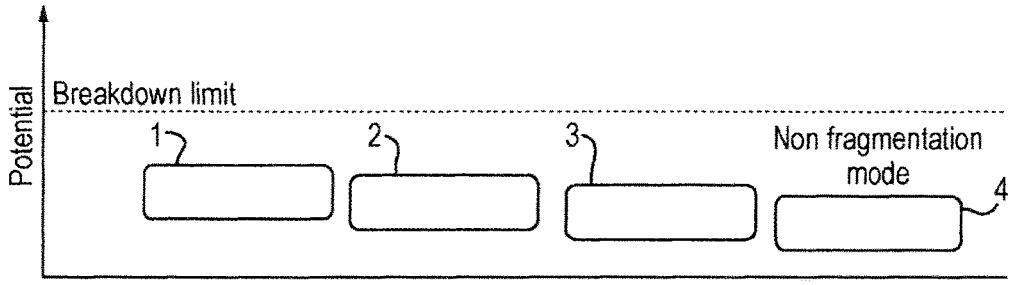
Fig. 1 Prior art
FIG. 1 shows a mass spectrometer being operated in a non-fragmentation mode according to a conventional approach.

FIG. 1 shows a conventional mass spectrometer being operated in a non-fragmentation mode. The position along the instrument of various devices (going downstream from left to right) and the electric potential at that position (represented by the vertical axis) are illustrated. The dotted line represents the electrical breakdown limit. The mass spectrometer comprises a first upstream device 1, a second upstream device 2, a gas-filled collision cell 3 and a downstream device 4.

In FIG. 1 the potentials are arranged to efficiently transmit ions along the device with minimal fragmentation. A slight potential drop is introduced between adjacent components. However, ions are passed from the second upstream device 2 into the collision cell 3 with insufficient energy to cause fragmentation. Without such focusing voltages, ions may effectively slow to a halt within the mass spectrometer.

It can be seen from FIG. 1 that the total potential drop along the length of the instrument is relatively small and that all of the components are held at relatively low absolute potentials below the limit of electrical breakdown as represented by the dotted line.

Figure 2:
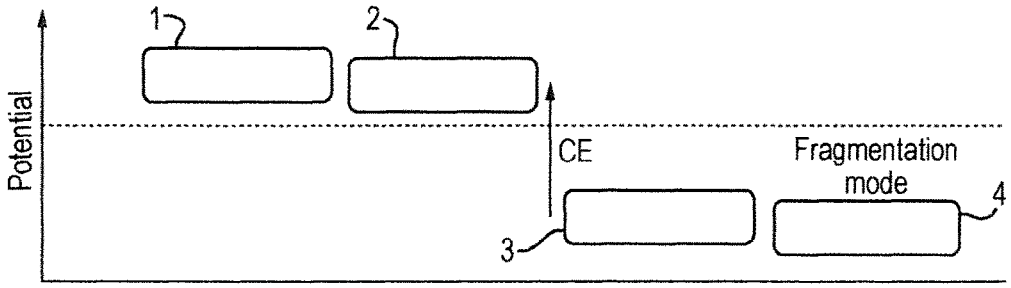
Fig. 2 Prior art
FIG. 2 shows a mass spectrometer being operated in a fragmentation mode according to a conventional approach.

A conventional mass spectrometer being operated in a conventional fragmentation mode will now be described with reference to FIG. 2. FIG. 2 illustrates the mass spectrometer as shown in FIG. 1 but arranged to perform collision-induced dissociation ("CID") of ions.

To induce fragmentation, a potential difference is introduced between the upstream devices 1,2 and the collision cell 3 by raising the absolute potential applied to the first upstream device 1 and the second upstream device 2. Ions in the second upstream device 2 will be accelerated through the potential difference between the exit of the second upstream device 2 and the entrance of the collision cell 3 into the collision cell 3. The collision energy is primarily determined by this potential difference and the degree of fragmentation can thus be controlled by adjusting the potential difference between the collision cell 3 and the upstream devices.

It is important to note that all of the devices upstream of the collision cell 3 must be raised at least by an amount corresponding to the collision energy to ensure that parent or precursor ions are efficiently transmitted to the collision cell 3 i.e. that the ions are transmitted from the first upstream device 1 to the second upstream device 2.

Since the upstream devices 1,2 are required to track or float the collision energy, the total potential drop along the length of the instrument as shown in FIG. 2 is relatively large. It can be seen from FIG. 2 that the upstream devices 1,2 are now held at relatively high absolute potentials above the electrical breakdown limit.

This cumulative effect may be compounded for instruments having additional upstream devices or additional upstream potential drops.

A first example illustrating some of the advantages of the techniques of the various embodiments will now be described with reference to FIG. 3.

Figure 3:
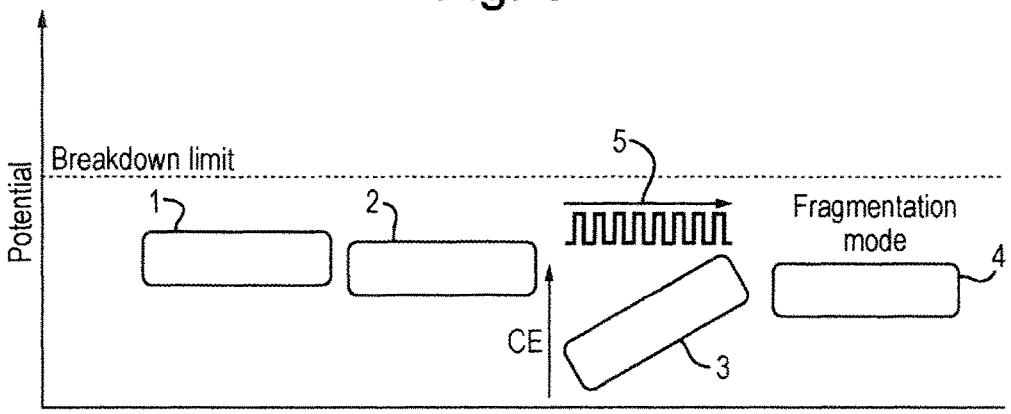
FIG. 3 shows a mass spectrometer being operated in a fragmentation mode according to an embodiment.

FIG. 3 shows a similar instrument to that described above being operated in a fragmentation mode according to an embodiment and with like reference signs representing like components.

The collision energy is determined by the potential difference between the exit of the second upstream device 2 and the entrance of the collision cell 3. However, in this embodiment the potential difference is introduced, at least in part, by applying a reverse axial DC electric field to the collision cell 3. The reverse axial electric field provides an increasing axial potential in the downstream direction so that the potential at the exit of the collision cell 3 is raised relative to the potential at the entrance. The potential drop defining the collision energy is therefore localised to region around the entrance of the collision cell 3.

To transmit ions from the collision cell 3 to a downstream device 4 it is necessary to drive ions against the reverse axial electric field. The collision cell 3 may generally comprise a plurality of electrodes and is segmented in the axial direction so that independent transient DC potentials or voltage waveforms can be applied to each segment. The transient DC potentials or voltage waveforms applied to each segment generate a travelling wave 5 which moves in the axial direction and urges or propels ions up or against the potential gradient of the reverse axial electric field.

Other means for driving ions against the reverse axial electric field include AC or RF pseudo-potential drives or gas flows.

By using a reverse axial field in combination with a travelling wave 5, the requirement for the first upstream device 1, second upstream device 2 and downstream device 4 to track the collision energy is advantageously avoided. Thus, these devices can potentially remain static i.e. at essentially the same potentials as during the non-fragmentation mode depicted in FIG. 1. It can be seen that introducing a reverse axial electric field in this manner enables the total potential drop along the length of the instrument and hence the absolute potential of the upstream devices to be reduced.

Another example illustrating some of the advantages of the techniques of the various embodiments will be described with reference to FIG. 4.

Figure 4:
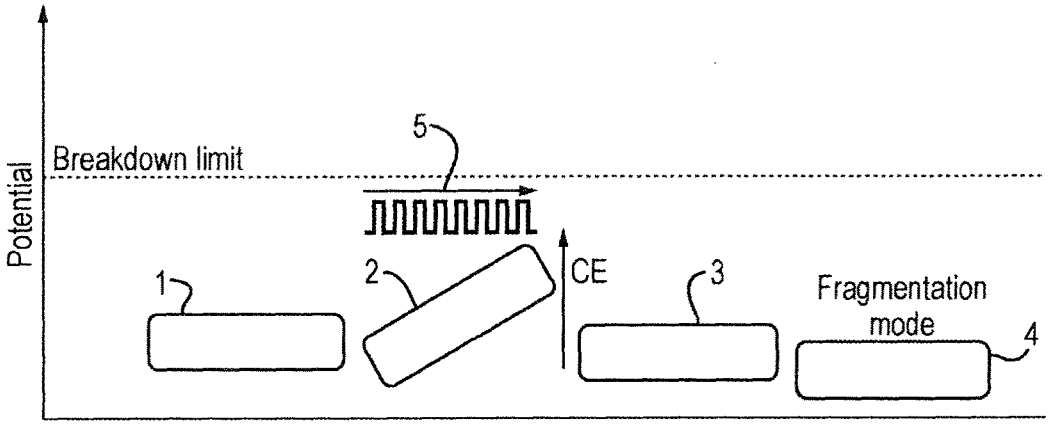
FIG. 4 shows a mass spectrometer being operated in a fragmentation mode according to another embodiment.

In FIG. 4, a reverse axial DC electric field is applied to the second upstream device 2 and the collision cell 3 is held static. Ions may be driven against the reverse axial electric field in a similar manner to that described above, for instance using travelling DC voltage waves 5. Again, a potential difference is introduced between the exit of the second upstream device 2 and the entrance of the collision cell 3 without requiring the other devices to track the collision energy. Thus, similarly to the embodiment shown in FIG. 3, the total potential drop and absolute potentials are reduced relative to the conventional mass spectrometer as shown in FIG. 2.

In the embodiments shown and described with reference to FIG. 3 and FIG. 4, the collision energy is controlled at least in part by adjusting the reverse axial electric field applied to the collision cell 3 or the second upstream device 2. However, other embodiments may employ a combination of any of the approaches described above. For instance, a reverse axial electric field may be applied to both the second upstream device 2 and the collision cell 3 to provide larger collision energies. Similarly, the potentials of the other upstream and downstream devices may be adjusted in addition to or in combination with the reverse axial electric field. This may be done in order to avoid introducing an overly steep reverse axial electric field gradient and/or to further increase the collision energy. In these embodiments the total potential drop along the instrument and/or absolute potentials of the upstream components are still reduced relative to the conventional mass spectrometer shown in FIG. 2.

In the embodiments described above the upstream devices may be any typical mass spectrometer components including one or more ambient or sub-ambient ionisation sources, ion guides, RF confined intermediate pressure regions, fragmentation or reaction devices, ion mobility devices, ion focusing optics, mass to charge ratio filters such as quadrupole mass filters and mass to charge ratio separators such as ion traps or Time of Flight mass analysers. Similarly, the downstream devices may include one or more RF confined intermediate pressure regions, fragmentation or reaction devices, ion mobility devices, ion focusing optics, mass to charge ratio filters such as quadrupole mass filters and mass to charge ratio separators such as ion traps or Time of Flight mass analysers. Although a collision cell is illustrated, it is emphasised that the various embodiments may apply equally to other devices which introduce or require a potential drop.

Figure 5:
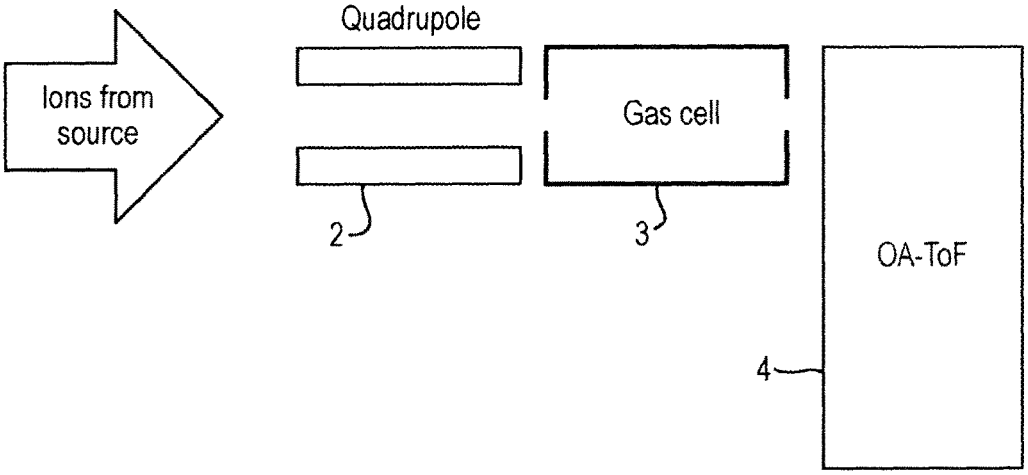
FIG. 5 shows a typical arrangement of components within a mass spectrometer.

FIG. 5 shows a typical arrangement of mass spectrometer components to which the embodiments described above may apply. In this configuration, a continuous beam of ions is generated in an ion source and the beam of ions is then passed to a quadrupole device (second upstream device 2), a gas cell (collision cell 3) and an orthogonal acceleration Time of Flight mass analyser (downstream device 4).

The number and order of these components is not intended to be limiting. Multiple devices may be combined and/or operated together within a single instrument to reduce the overall potential drop along an instrument. With reference to the embodiment shown in FIG. 3, the reverse axial electric field need not be provided directly adjacent to the local potential drop defining the collision energy. For example, the collision cell 3 may have no reverse axial electric field and a reverse axial electric field may be applied to a further non-illustrated component downstream of the collision cell 3.

The principles of the various embodiments described above apply equally to other configurations of mass spectrometer including a potential drop. For instance, there may be a relatively large potential drop along the length of the drift tube of an ion mobility separation device. In a similar manner to the embodiments described above, the total potential drop along the instrument can be reduced by introducing a reverse axial DC field to a component upstream or downstream of the ion mobility separation device.

Naturally, it is also possible to compensate for a reverse field gradient using one or more potential difference in an analogous or equivalent fashion. Indeed, it will be appreciated that the potential drop and the reverse field generally compensate each other to reduce the total potential drop.

Although the present invention has been described with reference to particular examples and embodiments, it will be understood by those skilled in the art that various changes in form and detail may be made without departing from the scope of the invention as set forth in the accompanying claims.

The invention claimed is:

1. A method of mass spectrometry comprising:

providing a first device and a second device disposed downstream of said first device;

introducing a potential difference between the exit of said first device and the entrance of said second device, wherein ions are accelerated through the potential difference into a fragmentation or reaction device such that the potential difference at least in part determines a collision energy of ions entering the fragmentation or reaction device;

reducing the total potential drop across the first and second devices by applying a reverse axial electric field to said first device and/or said second device; and driving ions through said first device and/or said second device against said reverse axial electric field.

2. A method as claimed in claim 1, wherein the potential drop between the entrance of said first device and the exit of said second device is less than said potential difference between the exit of said first device and the entrance of said second device.

3. A method as claimed in claim 1, comprising adjusting said reverse axial field to adjust said potential difference.

4. A method as claimed in claim 1, wherein said second device comprises said fragmentation or reaction device.

5. A method as claimed in claim 1, further comprising controlling the collision energy of ions entering said fragmentation or reaction device by adjusting said reverse axial electric field.

6. A method as claimed in claim 1, further comprising providing a continuous beam of ions to said first device and said second device.

7. A method as claimed in claim 1, wherein driving ions through said first device and/or said second device against said reverse axial electric field comprises:

(i) applying one or more transient DC voltages or potentials or one or more DC voltage or potential waveforms to a plurality of axial segments constituting said first and/or second device; and/or (ii) applying one or more AC or RF voltages or potentials or one or more AC or RF voltage or potential waveforms to a plurality of axial segments constituting said first and/or second device; and/or (iii) driving ions through said first device and/or said second device against said reverse axial electric field using a gas flow.

8. A method as claimed in claim 1, further comprising driving ions through said first device and/or said second device against said reverse axial electric field without ion mobility separation.

9. A method of mass spectrometry comprising:

reducing the potential drop between the entrance of a first device and the exit of a second device disposed downstream of the first device by applying a reverse axial electric field to said first device and/or said second device; and driving ions through said first device and/or said second device against said reverse axial electric field, wherein either:

(i) the reverse axial electric field is applied to the second device and the method further comprises introducing a forward axial electric field across the first device so that ions are caused to separate according to their ion mobility in the first device; or (ii) wherein said reverse axial electric field is applied to the first device and the method further comprises introducing a forward axial electric field across the second device so that ions are caused to separate according to their ion mobility in the second device.

10. A method as claimed in claim 9, further comprising providing a continuous beam of ions to said first device and said second device.

11. A method of mass spectrometry as claimed in claim 9, wherein driving ions through said first device and/or said second device against said reverse axial electric field comprises:

(i) applying one or more transient DC voltages or potentials or one or more DC voltage or potential waveforms to a plurality of axial segments constituting said second device; and/or (ii) applying one or more AC or RF voltages or potentials or one or more AC or RF voltage or potential waveforms to a plurality of axial segments constituting said second device.

12. A method as claimed in claim 9, further comprising driving ions through said first device and/or said second device against said reverse axial electric field using a gas flow.

13. A mass spectrometer comprising:

a first device and a second device disposed downstream of the first device, wherein either:

(i) a potential difference is applied between the exit of said first device and the entrance of said second device, wherein ions are accelerated through the potential difference into a fragmentation or reaction device such that the potential difference at least in part determines a collision energy of ions entering the fragmentation or reaction device and the mass spectrometer further comprises a device arranged and adapted to reduce the potential drop between the entrance of the first device and the exit of the second device by applying a reverse axial electric field to said first device and/or said second device; or (ii) a forward axial electric field is applied across either the first device or second device so that ions are caused to separate according to their ion mobility in that device, and a reverse axial electric field is applied to the other of the first device and second device in order to reduce the potential drop between the entrance of the first device and the exit of the second device;

and the mass spectrometer further comprising:

a device arranged and adapted to drive ions through said first device and/or said second device against said reverse axial electric field.

* * * * *